US005389754A

United States Patent [19]

Muller et al.

[11] Patent Number: 5,389,754

[45] Date of Patent: Feb. 14, 1995

[54] PRINTED CIRCUIT BOARD MOUNTED GUIDE SYSTEM

[75] Inventors: Robert D. Muller, Royal Oak; Robert D. Schmidt, Livonia, both of Mich.

[73] Assignee: United Technologies Automotive, Inc., Dearborn, Mich.

[21] Appl. No.: 148,934

[22] Filed: Nov. 8, 1993

[51] Int. Cl.[6] ..... H01H 9/00

[52] U.S. Cl. ..... 200/292; 200/252; 200/572; 361/809

[58] Field of Search ..... 200/292, 547, 548, 549, 200/550, 551, 572, 252, 257, 1 A; 361/756, 725, 802, 727, 809

[56] References Cited

U.S. PATENT DOCUMENTS 3,857,000 12/1974 Boulanger ..... 200/257
3,912,887 10/1975 Gratz et al. ..... 200/548
4,057,520 11/1977 Schwartz ..... 200/292
4,324,958 4/1982 Valleau ..... 200/548

*Primary Examiner*—Henry J. Recla
*Assistant Examiner*—David J. Walczak
*Attorney, Agent, or Firm*—Harness, Dickey & Pierce

[57] ABSTRACT

A switch mechanism having a set of movable conductive contacts adapted to selectively conductively engage a set of conductive paths formed on a printed circuit board in order to open and close circuit paths created thereby. A contact carrier retains the movable contacts in a predefined spaced relationship and slidingly engages a guide member adapted to predeterminately guide the movement of the carrier with respect to the circuit board, the guide member being fixedly secured to a surface of the printed circuit board substrate.

12 Claims, 3 Drawing Sheets

PRINTED CIRCUIT BOARD MOUNTED GUIDE SYSTEM

BACKGROUND OF THE INVENTION

The present invention relates generally to electrical switches and, more particularly, to a switch utilizing movable contacts and a printed circuit board as the switching element, having a guide member for the contact carrier mounted directly to the printed circuit board substrate.

One commonly used type of switch mechanism includes a set of sliding contacts which electrically engage a series of conductive paths printed on a circuit board substrate. Switch mechanisms of this type are often used, for example, in the automotive industry for headlamp and other control switches placed on a vehicle dash panel. The switch contacts are typically retained by a contact carrier and movement of the contact carrier, and therefore travel of the contacts with respect to the circuit paths, is controlled via a guide member which controllably engages the carrier. This guide member is typically formed separately from the circuit board and contains a projecting portion which extends upwardly through a suitable opening in the circuit board. This projecting portion is typically slidingly engaged by the contact carrier and thereby aligns the contacts with respect to the conductive paths, controlling the direction of travel. The contact carrier is further engaged by a means for causing movement thereof along the guide member, such as a pin whose movement is caused by rotation of a thumb wheel or actuation of another type of rotary or linearly sliding knob.

This control guide arrangement, however, may have several inherent drawbacks. Forming the guide member separately, typically as part of a protective housing which surrounds the switch mechanism, can negatively affect manufacturability. Holding closer to tolerances between the housing and other switch components is required and the assembly process is made more difficult. Repairability of the switch is also hindered by requiring replacement of a greater portion of the switch if a malfunction or damage to the switch occurs. Separately formed components also result in a larger resulting overall tolerance between the guide member and contact carrier, thus affecting part functionality and reliability as well as requiring more space.

This space requirement can be a problem since the design envelopes being made available for such switches in automobile dash panels are shrinking, with increasingly less space in the dash being devoted for such switches. Switch designers therefore often face the task of providing a functional and reliable switch mechanism in the smallest possible space. Therefore, there exists a need for a switch mechanism of this general type with a reduced space requirement. Such a switch must also be reliable, cost effective and facilitate ease of assembly.

SUMMARY OF THE INVENTION

The present invention meets this design challenge by providing an improved switch mechanism in which the guide member is secured directly to the printed circuit board substrate, instead of being formed separately and passed through a corresponding opening in the substrate. A set of movable conductive contacts are adapted to selectively electrically engage a set of conductive paths formed on the printed circuit board in order to selectively open and close circuit paths created thereby and effect switching. A contact carrier retains the movable contacts in a predefined spaced relationship and also engages the guide member which predeterminately guides the movement of the carrier with respect to the circuit board.

The carrier guide, rather than being passed through an opening in the circuit board substrate, is fixedly secured to a surface of the substrate, thereby simplifying design and construction of the switch mechanism housing. By accurately securing the guide member to a surface of the printed circuit board substrate, greater reliability is achieved through the elimination of tolerance stack ups and the switch mechanism can be made smaller than one having separate circuit board and guide means. These and other advantages and features of the present invention will become apparent from the subsequent description and the appended claims, taken in conjunction with the accompanying drawings.

DETAILED DESCRIPTION OF A PREFERRED EMBODIMENT

Figure 1:
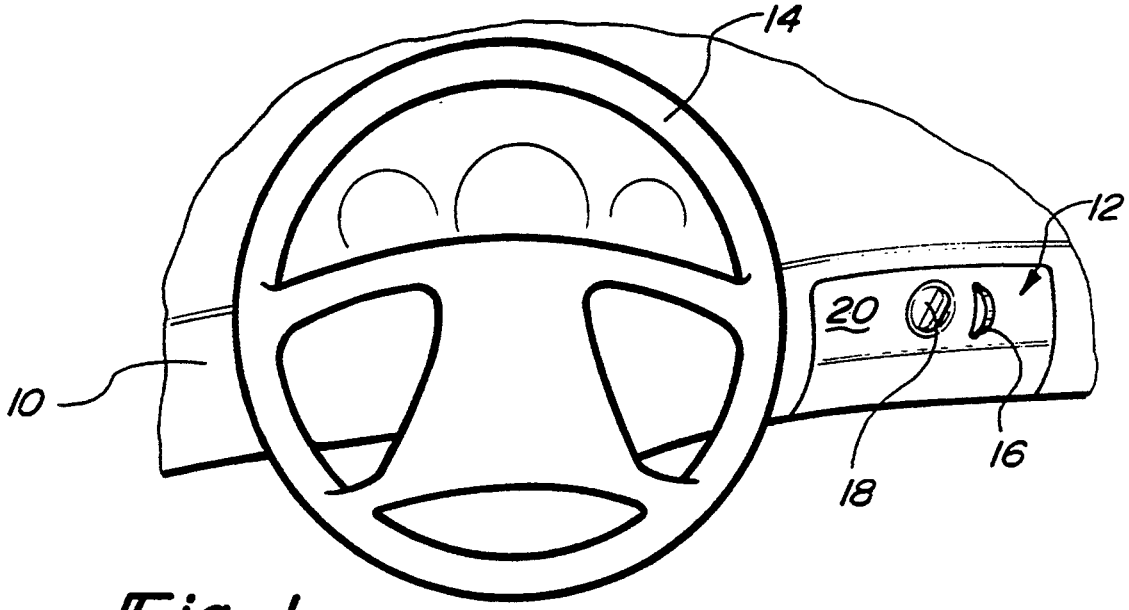
FIG. 1 is a front elevational view of a vehicle dashboard having mounted therein a switch mechanism according to the present invention.

Referring now to the drawings, FIG. 1 illustrates a dashboard portion 10 of a vehicle having mounted thereto a switch mechanism 12 of the present invention, adjacent the vehicle steering wheel 14. As shown in the figure, switch 12 includes both a thumb wheel knob 16 and rotatable knob 18, each of which preferably project through corresponding apertures formed through a face plate 20 of switch 12. Face plate 20 preferably fits within a corresponding opening in dash 10 and is contoured so as to lie flush therewith.

Figure 2:
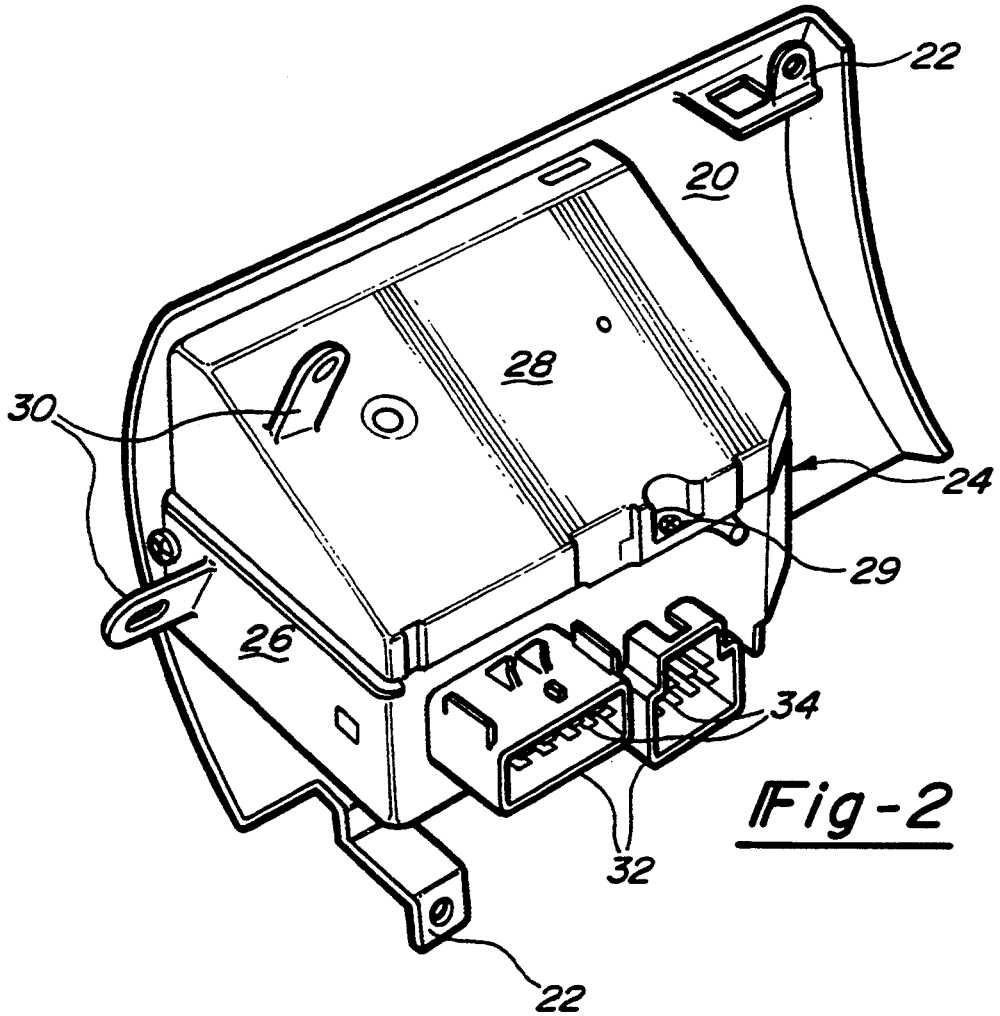
FIG. 2 is a perspective view, taken from behind the dashboard, of the switch enclosed by a protective surrounding housing.

Turning now to FIG. 2, the interior surface of face plate 20 has attached thereto a number of mounting brackets 22, useful for securely mounting face plate 20 with respect to dash panel 10. Face plate 20 also has securely fastened thereto a protective enclosing housing 24 for switch mechanism 12. Housing 24 is preferably formed of a hard plastic, polymeric material or other nonconductive material in two separate pieces, as a base 26 and a cover 28, which preferably snap together or are otherwise securable to one another, such as by a threaded fastener 29. Base 26 and cover 28 of housing 24 may also have attached thereto, or integrally formed therewith, one or more brackets or tabs 30, also useful in securing housing 24 to various inner dash components.

Housing base 26 preferably also has attached thereto or formed integrally therewith, at least one connector guide 32 for use in physically and electrically connecting switch mechanism 12 to the vehicle's electrical system, such as via a mating connector and attached cabling (not shown). The electrical connection from switch 12 may be made in any one of a number of methods, but in this exemplary embodiment is made with conductive metallic contact strips 34, preferably copper or other suitable conductive material, which project outwardly from housing 24 through the centers of surrounding portions of connector guides 32.

Figure 3:
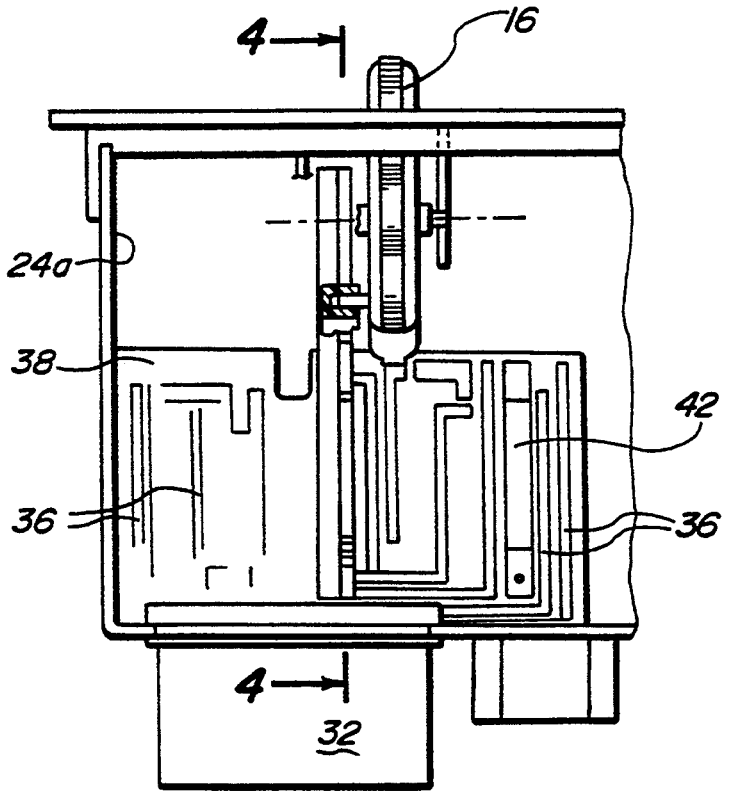
FIG. 3 is a plan view of the present switch wherein the protective housing has been removed to reveal the inner components of the switch mechanism.

From FIG. 3, a partial view of switch 12 having upper cover 28 of housing 24 removed, it can be appreciated that contact strips 34 project from guides 32 into an interior cavity 24*a* formed by enclosing housing 24, wherein they are electrically connected to conductive traces or paths 36 which have been formed on a printed circuit board 38. The electrical connection between contact strips 34 and conductive paths 36 may be made in any of a variety of manners such as by soldering. Conductive paths 36 can be formed on circuit board substrate 38 by any suitable method such as a photolithographic or similar process or may be insert molded therein. Paths 36 are arranged in a manner so as to enable switching the flow of electrical current between paths or combination of paths 36.

Figure 5:
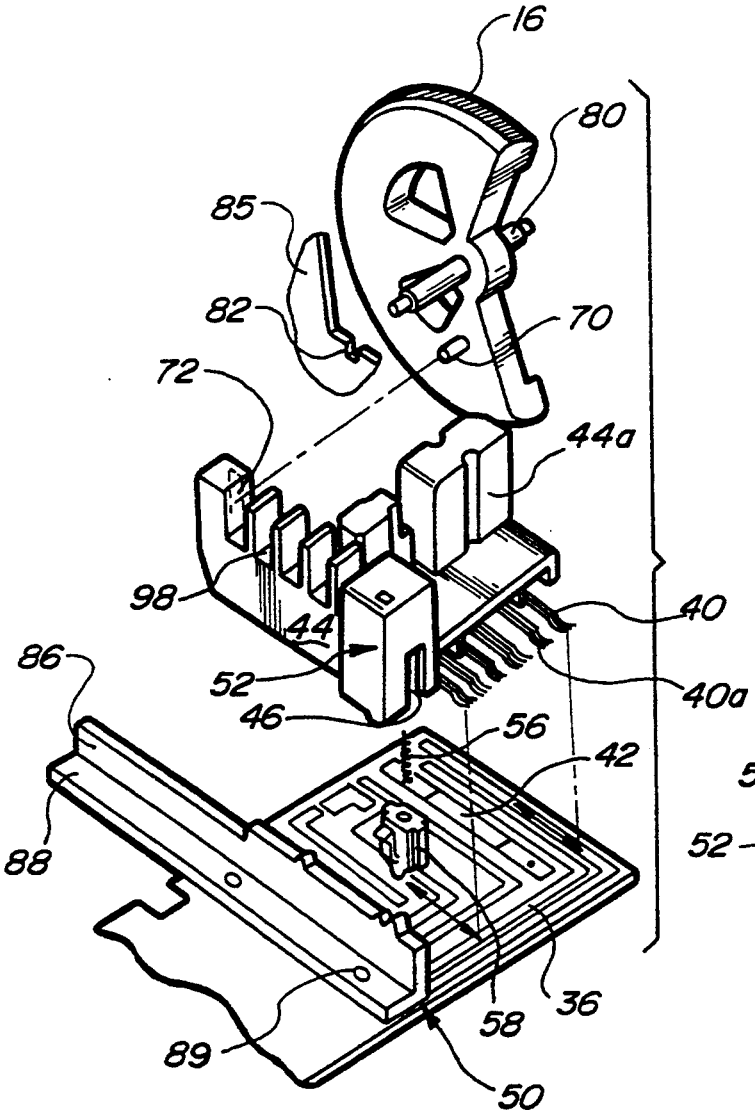
FIG. 5 is an exploded perspective view illustrating the components shown in FIGS. 4 and 5 in greater detail.

Electrical current received through contact strips 34 is conducted between paths 36 by a series of movable conductive contacts such as brush type metallic contacts 40, illustrated more clearly in FIG. 5. Contacts 40 move with respect to conductive paths 36 in order to make and break electrical paths therebetween and thereby direct current flow between selected contact strips 34 and on to the main electrical system of the vehicle, as well as to components being controlled by switch 12, in this exemplary embodiment a set of vehicle headlamps. One or more resistive elements such as a resistor 42 may also be placed on circuit board 38 as part of conductive paths 36 in order to perform functions such as interior vehicle lamp dimming.

Each contact 40 in this exemplary embodiment has one free end 40*a* and an opposing restrained end (not shown), with the restrained end being secured in suitably constructed portions 44*a* of a contact carrier 44. Contact carrier 44 is preferably made of a molded plastic or polymeric material and portion 44*a* is configured so as to space each of contacts 40 in a predefined manner, a predetermined distance apart from each other and such that each can be made to selectively contact a particular portion of particular paths 36.

In addition to retaining contacts 40, contact carrier 44 also includes means for guiding contacts 40 in a predetermined manner along the various paths 36. In this exemplary embodiment, a channel 46 is formed longitudinally through contact carrier 44 and slidingly engages a corresponding runner guide 50. Runner guide 50 in this embodiment is placed parallel to the desired path of travel of contacts 40, but in a different contact configuration could alternately be oriented in any other suitable fashion. Runner guide 50 preferably includes at least one portion having a cross-sectional shape, generally rectangular in the presently preferred embodiment, which generally corresponds to that of channel 46 so as to facilitate sliding engagement of contact carrier 44 along runner guide 50.

Channel 46 of contact carrier 44 is biased upwardly away from runner guide 50 so as to reduce frictional forces therebetween and provide a smooth and controlled sliding motion. In the present embodiment this biasing is accomplished via the length and structure of brush contacts 40 as well as by a biasing device 52. Device 52 in this embodiment is preferably integrally formed with contact carrier 44, as a cavity 54 formed therein in which there is disposed a spring member 56. Spring 56 pushes at one end thereof against a top surface 54*a* of cavity 54 and applies a biasing force at its opposite end against a bias member 58. Spring 56 is also preferably retained within a generally cylindrical bore 59 formed in member 58.

Member 58 is held within cavity 54 against spring 56 by cantilevered retainer clip 60 having a barbed head 62 which engages a projecting shoulder 64 formed on an inside surface of cavity 54. Member 58 is preferably made of a lubricious material such as nylon to reduce friction without necessitating additional lubricant. Device 52 also has preferably formed therein an opening 66 through which an appropriately fashioned tool such as pin or flat head screwdriver 68 may be passed and manipulated to release retainer clip 60 from shoulder 64 for purposes such as service. A bottom portion 58*a* of bias member 58 is formed so as to ride smoothly along runner guide 50 and therefore is preferably rounded or radiused in cross-sectional shape.

Figure 6:
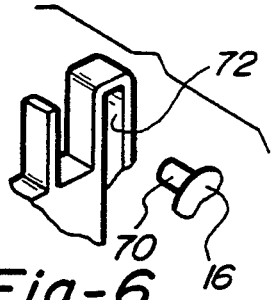
FIG. 6 is a detailed view of the thumb wheel pin and corresponding engaging opening in the contact carrier.
Figure 7:
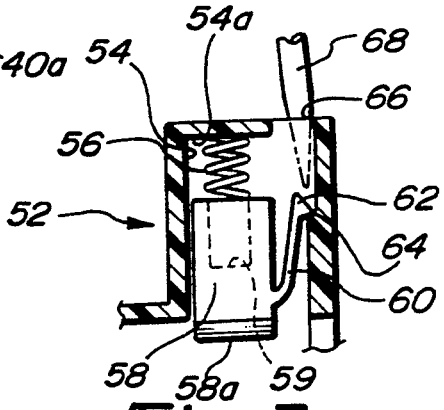
FIG. 7 is a detailed cross-sectional view, taken generally through line 7—7 of FIG. 4, of the spring biased end member of the contact carrier.

Movement of contact carrier 44 along runner guide 50 is facilitated by cooperating portions of contact carrier 44 and a projecting pin 70 formed on thumb wheel 16. Pin 70 fits within an inverted U-shaped slot 72 formed in a portion of carrier 44, as more clearly shown in FIGS. 5 and 6. Thumb wheel 16 is supported via a center shaft 80 and pivots about an axis therethrough. As shown more clearly in the side view of FIG. 4, pivoting of thumb wheel 16 around shaft 80 causes displacement of pin 70 substantially along the axis of bidirectional travel of contact carrier 44. Vertical movement due to rotational or arcuate travel of pin 70 is compensated for by up and down movement of pin 70 within elongated slot 72. Shaft 80 is secured in an aperture 82 formed in a suitably formed flange 85 disposed within cavity 24*a* in housing 24, preferably formed as an integral part of housing 24.

Figure 4:
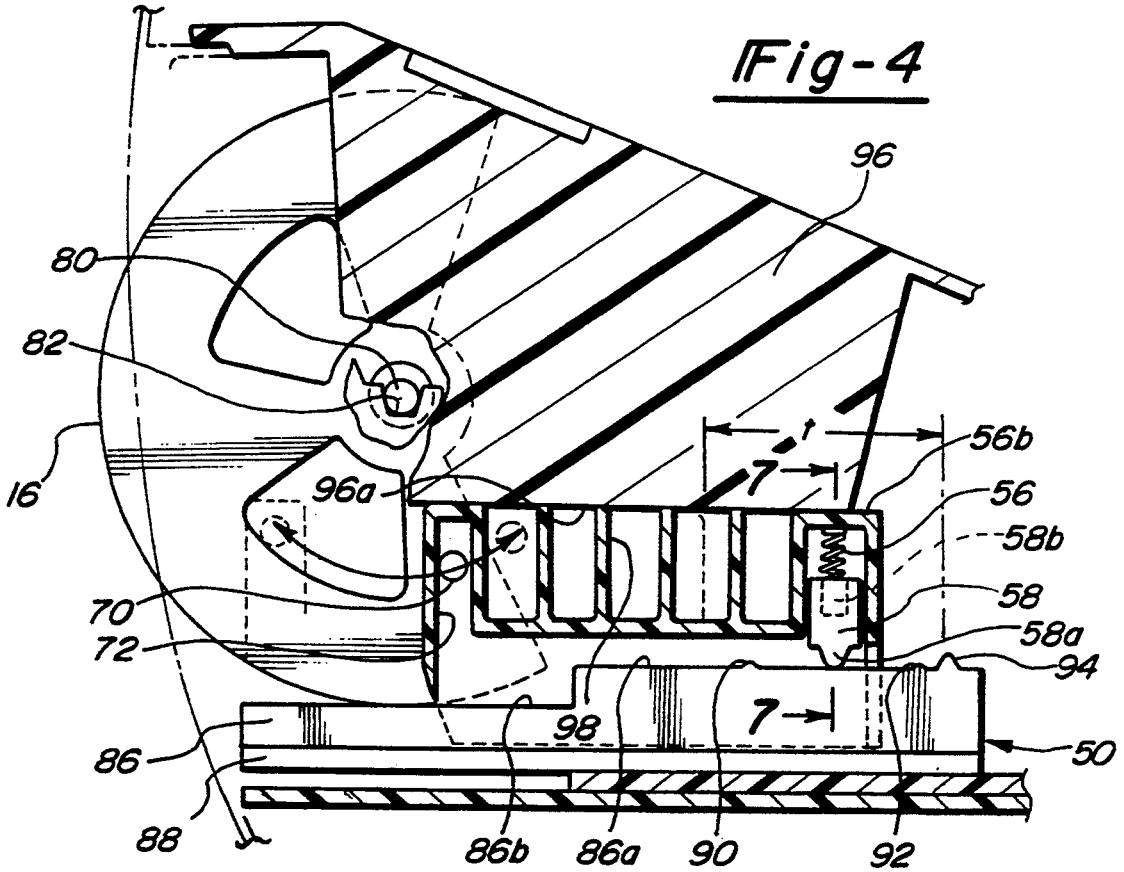
FIG. 4 is a cross-sectional view, partially broken away, taken generally through line 4—4 of FIG. 3, which illustrates the manner in which a projecting pin on a thumb wheel knob may be used to move the contact carrier along the guide member.

As shown in FIG. 4, runner guide 50 includes an upstanding portion 86, which is slidably engaged by channel 46 of contact carrier 44, and an orthogonal support portion 88 which is used to secure runner guide 50 to circuit board 38 using any one of a number of suitable methods including threaded fasteners or screws 89, push fasteners, sonic welding or heat staking. Alternately, however, runner guide 50 could be of any suitable shape. Upstanding portion 86 of runner guide 50 has a first surface 86*a*, upon which retainer radiused member portion 58*a* slides, and a second surface 86*b*, cut away from runner guide 50 to provide necessary clearance for thumb wheel knob 16.

Surface 86*a* further has disposed thereon or formed therein, a series of projections which act as a detent mechanism and also provide tactile feedback and a "clicking" sound to the driver, indicative of on and off positions of the switch. A first projection 90 is engaged by radiused head 58*a* of member 58 at an uppermost rotational position of thumb wheel 16 and a second projection 92 at a lowermost rotational position, thereby providing a distance of travel "t" of contact carrier 44. A stop projection 94 further provides a mechanical stop for member 58 and therefore thumb wheel 16. Member 58 is held downwardly against guide surface 86*a* by a flange or partition 96 formed in the interior of housing cover 28. Flange surface 96*a* is formed so as to slidingly engage a top surface 56*b* of member 56 as well as a series of parallel upstanding members 98 of contact carrier 44, as contact carrier 44 travels along runner guide 50.

Placement of runner guide 50 directly upon a top surface of printed circuit board 34 allows elimination of a hole formed therethrough through which projects a carrier guide member which has been formed as part of housing bottom section 26. This structural configuration simplifies the structure of the housing as well as allows for a closer tolerance by eliminating a toleranced fit and resulting tolerance stack ups. This configuration also produces a simpler, more reliable switch mechanism and allows the switch to be built more compactly, thereby satisfying the most restrictive design envelope constraints.

Although switch mechanism 12 is illustrated in this exemplary application as a headlight switch for an automotive vehicle, it should be apparent that there are a wide variety of additional applications in which switch 12 can be successfully employed both within and outside of the automotive industry. More specifically, this switch provides an improved design for any switch which utilizes travel of a set of contacts along conductive paths on a printed circuit board.

The foregoing discussion discloses and describes merely exemplary embodiments of the present invention. One skilled in the art will readily recognize from such discussion, and from the accompanying drawings and claims, that various changes and modifications can be made therein without departing from the spirit and scope of the invention as defined in the following claims.

What is claimed is:

1. A switch mechanism comprising:

a set of conductive paths formed on a surface of a substrate;

a set of movable conductive contacts adapted to selectively conductively engage said conductive paths to open and close circuit paths created thereby;

a contact carrier for retaining said movable contacts in a predefined spaced relationship;

a guide member adapted to engage said contact carrier and predeterminately guide the movement of said carrier with respect to said substrate, said guide member being fixedly secured to said surface of said substrate;

actuation means for causing movement of said contact carrier along said guide member, said actuation means including a projection for engaging said contact carrier; and said contact carrier further including an inverted u-shaped slot and said projection including a pin member for engaging said slot.

2. The mechanism of claim 1 wherein said guide member is disposed on said substrate adjacent said conductive paths and parallel to a direction of travel of said contact carrier and movable contacts.

3. The mechanism of claim 1 wherein said contact carrier includes means for slidably engaging said guide member.

4. The mechanism of claim 3 wherein said means for slidably engaging comprises a channel formed longitudinally through said contact carrier, said channel adapted to slidingly engage a corresponding portion of said guide member.

5. The mechanism of claim 1 wherein said pin member projects outwardly from a surface of a thumb wheel switch whereby rotation of said thumb wheel causes movement of said carrier along said guide means.

6. The mechanism of claim 1 further comprising biasing means for biasing said carrier away from said guide member, said biasing means including a spring loaded member formed at one end of said carrier.

7. The mechanism of claim 6 wherein said spring loaded member includes a retainer member adapted to slidingly engage a surface of said guide member between two detented positions.

8. The mechanism of claim 7 wherein each detented position is created by a projection on a surface of said guide member engaged by said spring loaded member.

9. The mechanism of claim 1 wherein said substrate comprises a printed circuit board substrate; and wherein said conductive paths are printed on said printed circuit board substrate.

10. The mechanism of claim 9 wherein said guide member is secured to said substrate surface by at least one fastener.

11. A vehicle headlamp switch mechanism comprising:

a set of conductive paths formed on a surface of a printed circuit board substrate;

a set of movable conductive contacts adapted to selectively conductively engage said conductive paths to open and close circuit paths created thereby;

a contact carrier for retaining said movable contacts in a predefined spaced relationship, said contact carrier having a generally rectangular channel formed longitudinally therethrough;

a guide member having a first generally rectangular upstanding portion adapted to slidingly engage said channel formed in said contact carrier and thereby predeterminately guide the movement of said carrier with respect to said circuit board substrate, said guide member having a second portion orthogonal to said first upstanding portion, said second portion being fixedly secured to said circuit board substrate adjacent said conductive paths;

actuation means having a pin member which engages said contact carrier for causing movement of said contact carrier along said guide member;

a spring loaded member adapted to engage a surface of said guide member and bias said contact carrier away from said guide member; and a pair of projections on said surface of said guide member engaged by said spring loaded member, said projections forming a detent mechanism for said switch.

12. A switch mechanism comprising:

a printed circuit board having a plurality of conductive paths formed thereon in spaced apart relation to each other;

a plurality of movable conductive contacts adapted to selectively conductively engage selected ones of said conductive paths;

a contact carrier for retaining said moveable contacts in a predefined spaced relationship;

a guide member secured to said printed circuit board and adapted to protrude outwardly of said printed circuit board generally toward said contact carrier without protruding through said printed circuit board;

said contact carrier including a longitudinal channel formed therein adapted to slidably engage with said guide member when said contact carrier is assembled to said printed circuit board; and actuation means for causing sliding movement of said contact carrier relative to said printed circuit board along said guide member to selectively couple selected ones of said conductive paths together.

* * * * *